US007189935B1

(12) United States Patent
Hassan et al.

(10) Patent No.: US 7,189,935 B1
(45) Date of Patent: Mar. 13, 2007

(54) CONTACT ARM APPARATUS AND METHOD OF ASSEMBLY THEREOF

(75) Inventors: Girish Hassan, Andhra Pradesh (IN); Narayansamy Soundararajan, Andhra Pradesh (IN); Yatin Vilas Newase, Maharashtra (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/298,078

(22) Filed: Dec. 8, 2005

(51) Int. Cl.
*H01H 3/00* (2006.01)

(52) U.S. Cl. ..... 200/244; 335/16

(58) Field of Classification Search ..... 200/244, 200/248, 275, 243; 218/22, 146, 30–33; 335/16, 147, 195
See application file for complete search history.

(56) References Cited

U.S. PATENT DOCUMENTS 4,649,247 A * 3/1987 Preuss et al. ..... 200/244
4,910,485 A 3/1990 Bolongeat-Mobleu ..... 335/195
6,114,641 A 9/2000 Castonguay ..... 200/244
6,259,048 B1 * 7/2001 Castonguay et al. ..... 200/244
6,310,307 B1 * 10/2001 Ciarcia et al. ..... 200/244
6,366,438 B1 * 4/2002 Bauer ..... 335/16
6,403,901 B1 6/2002 Boeder ..... 200/244
6,639,168 B1 * 10/2003 Castonguay et al. ..... 335/16
6,960,731 B2 * 11/2005 Azzola et al. ..... 200/244
6,965,292 B2 * 11/2005 Ciarcia et al. ..... 200/243
7,005,594 B2 * 2/2006 Kim ..... 200/244

* cited by examiner

*Primary Examiner*—Michael A Friedhofer
(74) *Attorney, Agent, or Firm*—Cantor Colburn LLP

(57) ABSTRACT

A contact arm assembly having a contact arm module is disclosed. The contact arm module includes a set of contact arms, two side plates, a pivot pin, and a set of springs. Each contact arm includes a pivot hole, two contacts, and two spring holders. The two side plates are disposed on an opposing side of the set of contact arms, each side plate having a pivot hole, and first and second support anchors. A first spring support is disposed at the first support anchors of each side plate, and a second spring support is disposed at the second support anchors of each side plate. The pivot pin is disposed through the pivot holes of the set of contact arms and the pivot holes of the two side plates. The set of springs are disposed between one of the first and second spring supports and one of the spring holders of the set of contact arms.

20 Claims, 10 Drawing Sheets

CONTACT ARM APPARATUS AND METHOD OF ASSEMBLY THEREOF

BACKGROUND OF THE INVENTION

The present disclosure relates generally to circuit breakers and particularly to a contact arm assembly for a circuit breaker.

Multipole circuit breakers configured to protect multiphase electrical circuits are known in the electrical circuit protection industry. The variety of constructions of multipole circuit breakers include blow open and non-blow open contact arms, overcentering and non-overcentering contact arms, single contact pair arrangements with the contact pair at one end of a contact arm and a pivot at the other end thereof, double contact pair arrangements (referred to as rotary breakers) with a contact pair at each end of a contact arm and a contact arm pivot intermediate (typically centrally located between) the two ends, single housing constructions with the circuit breaker components housed within a single case and cover, and cassette type constructions (referred to as cassette breakers) with the current carrying components of each phase housed within a phase cassette and each phase cassette housed within a case and cover that also houses the operating mechanism. Multipole circuit breakers are generally available in two, three, and four pole arrangements, with the two and three pole arrangements being used in two and three phase circuits, respectively. Four pole arrangements are typically employed on three phase circuits having switching neutrals, where the fourth pole operates to open and close the neutral circuit in a coordinated arrangement with the opening and closing of the primary circuit phases. While existing circuit breakers are considered suitable for their intended purpose, the art of circuit breakers may be improved by providing a rotary contact arrangement having compression springs arranged between a rotor assembly and a rotary contact arm that maintain good electrical connection between the contacts during quiescent operating conditions, enhance contact separation upon occurrence of overcurrent conditions, and provide for ease of assembly.

BRIEF DESCRIPTION OF THE INVENTION

An embodiment of the invention includes a contact arm assembly having a contact arm module. The contact arm module includes a set of contact arms, two side plates, a pivot pin, and a set of springs. Each contact arm includes a pivot hole, two contacts, and two spring holders. The two side plates are disposed on an opposing side of the set of contact arms, each side plate having a pivot hole, and first and second support anchors. A first spring support is disposed at the first support anchors of each side plate, and a second spring support is disposed at the second support anchors of each side plate. The pivot pin is disposed through the pivot holes of the set of contact arms and the pivot holes of the two side plates. The set of springs are disposed between one of the first and second spring supports and one of the spring holders of the set of contact arms.

Another embodiment of the invention includes a contact arm assembly having a set of contact arms, two side plates, and a set of spring. Each contact arm of the set of contact arms have a pivot hole. Each of the two side plates are disposed on an opposing side of the set of contact arms. Two spring supports are disposed between the two side plates and are parallel to each other. The set of springs are captivated between the set of contact arms and at least one of the two spring supports.

Another embodiment of the invention includes a method of assembling a contact arm assembly, the contact arm assembly having a contact arm module and a rotor, the rotor having a cavity with interior side walls, the contact arm module having a set of contact arms captivated between and pivotally arranged with two side plates. The contact arm module with the set of contact arms and side plates is received in a first angular orientation defined by an interior angle A, then the set of contact arms is rotated relative to the side plates in a direction that increases the interior angle A, thereby defining a second angular orientation. With the contact arm module in the second angular orientation, the contact arm module is inserted into the cavity of the rotor such that the side plates engage with the interior side walls of the cavity. The set of contact arms is then rotated relative to the side plates to cause the contact arm module to return toward the first angular orientation, thereby captivating the contact arm module within the rotor.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a double break rotary contact arm assembly that may be used within a single or multi pole circuit breaker. An embodiment of the contact arm assembly includes a rotor and a plurality of rotary contact arm modules, each contact arm module having a plurality of contact arms straddled by a pair of side plates having a common pivot to the contact arms. The pair of side plates is contained within the rotor. In an embodiment, pluralities of springs are connected between the contact arms and a pin attached to the side plates, each contact arm having two springs. The contact springs are arranged such that contact pressure (force) at the interface of stationary and movable contacts will be about constant at the closed position. As the contact arms blow open during a short circuit condition, the closing moment attributed to the contact spring forces comes down. Accordingly, the force required to blow open the contact arms will gradually reduce as the movable contacts are blown away from the fixed contacts during a short circuit condition, which helps provide faster opening speed of the contact arms during a short circuit.

Figure 1:
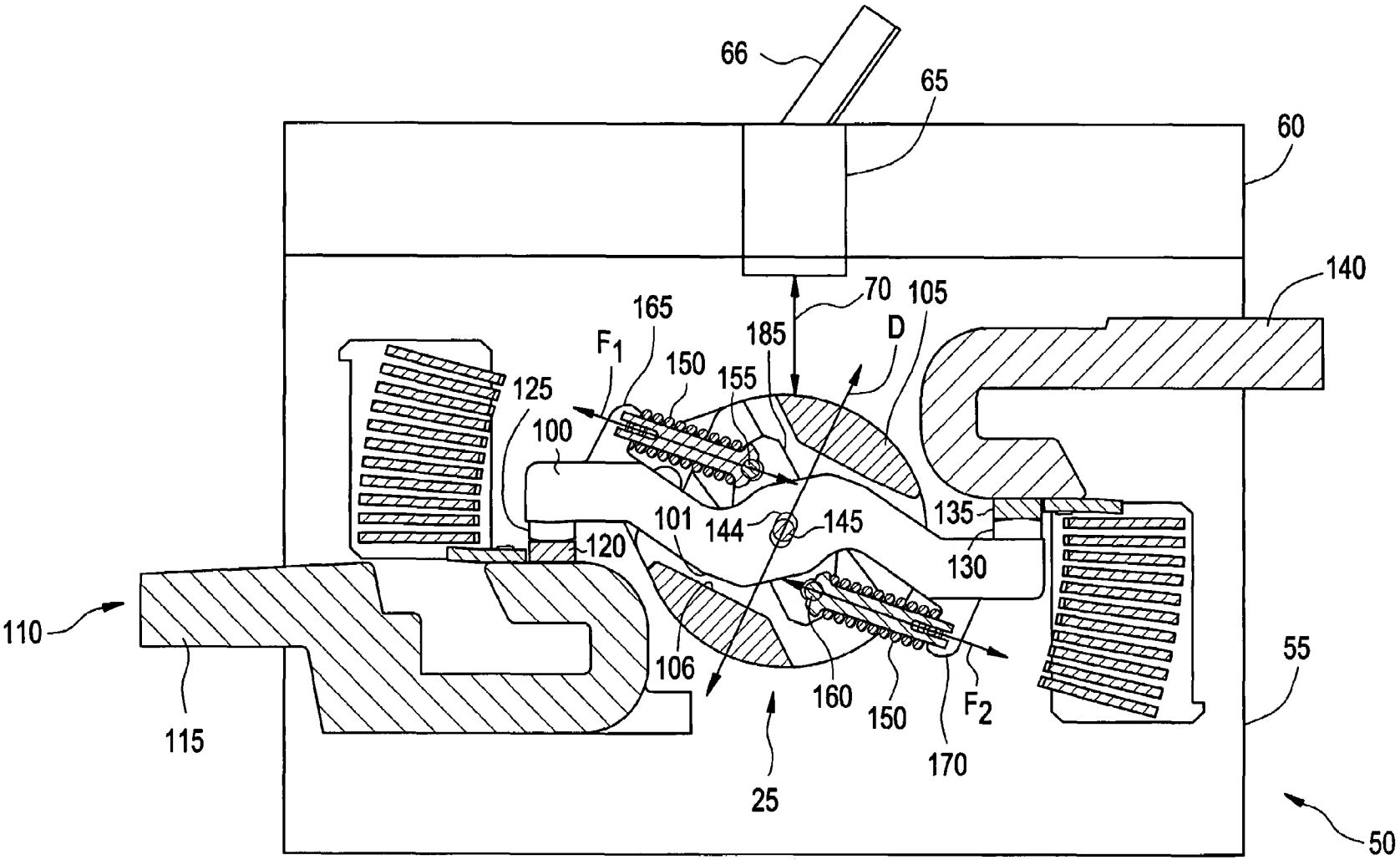
FIG. 1 depicts in cross section view a schematic circuit breaker incorporating an exemplary contact arm assembly in accordance with an embodiment of the invention with the contact arm in the CLOSED position.

A circuit breaker 50 is depicted in FIG. 1 having a base 55 and a cover 60. Within the base 55 and cover 60 are a contact arm assembly 25, a line strap 115, and a load strap 140. In the example of FIG. 1, an operating mechanism 65 with handle 66 is used via a linkage 70 to turn the circuit breaker 500N and OFF in a manner known in the art. FIG. 1 illustrates the situation where the operating mechanism 65 has positioned the contact arm assembly 25 in the ON position, creating a CLOSED conduction path 110. The conduction path 110 includes a contact arm 100 with movable contacts 125, 130 at opposite ends thereof, the line strap 115, the load strap 140, a fixed contact 120 disposed on the line strap 115, and a fixed contact 135 disposed on the load strap 140. Contact arm 100 includes a slotted pivot hole 144 that is centrally disposed between movable contacts 125, 130. When circuit breaker 50 is electrically connected to an electrical circuit via connectors (not shown) on line strap 115 and load strap 140, and is turned ON, the electrical current flows through line strap 115, fixed contact 120, movable contact 125, contact arm 100, movable contact 130, fixed contact 135, and load strap 140. Operating mechanism 65 opens and closes conduction path 110 via linkage 70 by rotating a rotor 105, which is coupled to and in turn rotates contact arm 100 about its central axis (designated generally by reference numeral 145). The relationship between contact arm 100 and rotor 105 will be discussed further below.

While FIG. 1 illustrates only a single contact arm 100, it will be appreciated that this is for illustration purposes only, as will be evident by the discussion below.

Figure 2:
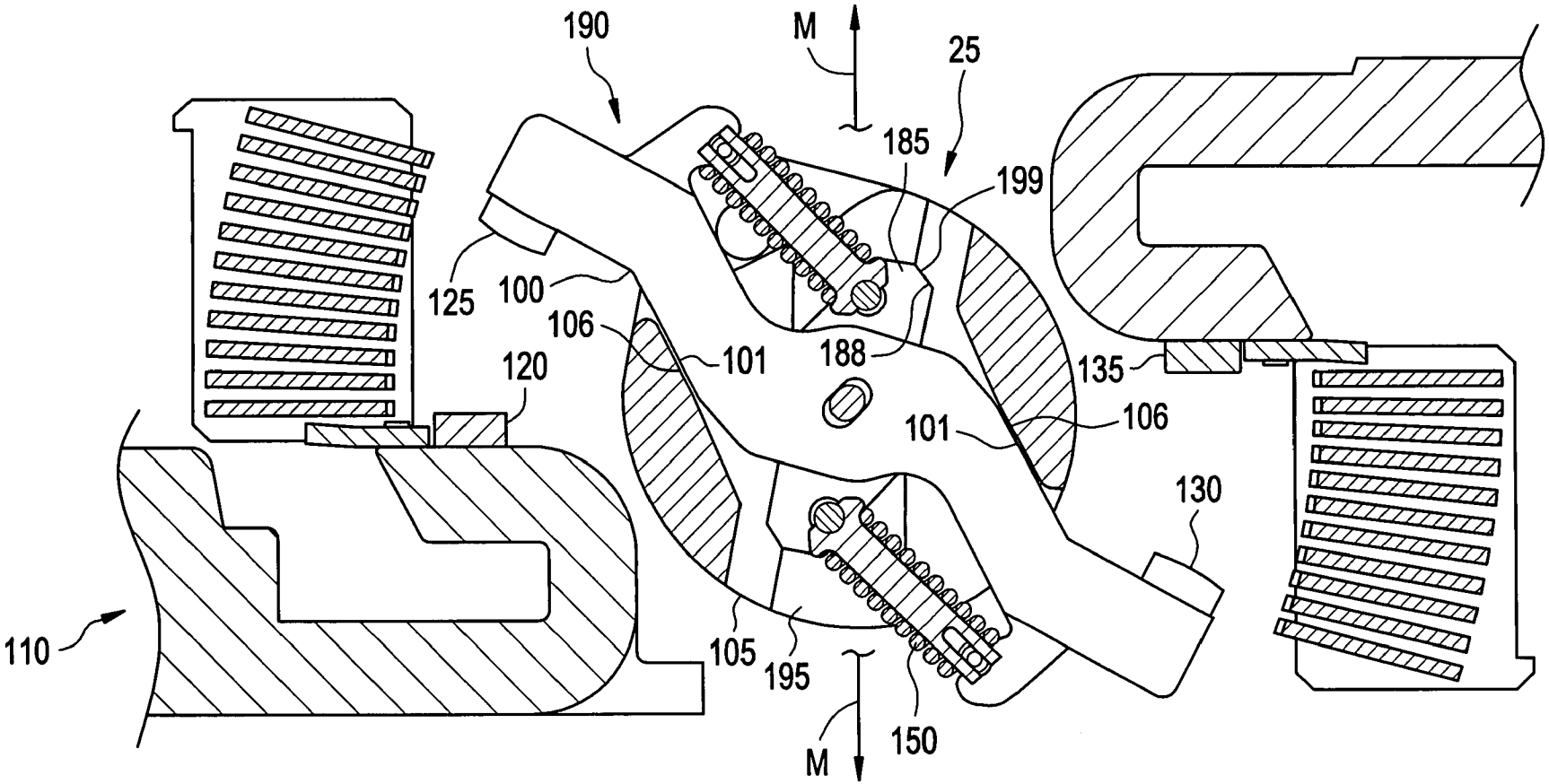
FIG. 2 depicts in cross section view the contact arm assembly of FIG. 1 with the contact arm in the OPEN position.

Referring now to FIG. 2, which illustrates an example where the operating mechanism 65 (not specifically shown in FIG. 2) has been placed in the OFF position, thereby causing the linkage 70 to rotate the rotor 105 in a clockwise direction to create an OPEN conduction path 110. As the rotor 105 rotates clockwise from the position shown in FIG. 1, the initial rotation of rotor 105 does not cause rotation of the contact arm 100 due to a clearance between the rotor 105 and the contact arm 100, shown in FIG. 1 by a separation between surfaces 101 and 106. However, when surface 106 of the rotor 105 contacts surface 101 of the contact arm 100, the rotor 105 and contact arm 100 rotate together, which causes the movable contacts 125, 130 to separate from the fixed contacts 120,135, thereby resulting in an interruption of the conduction path 110.

Figure 3:
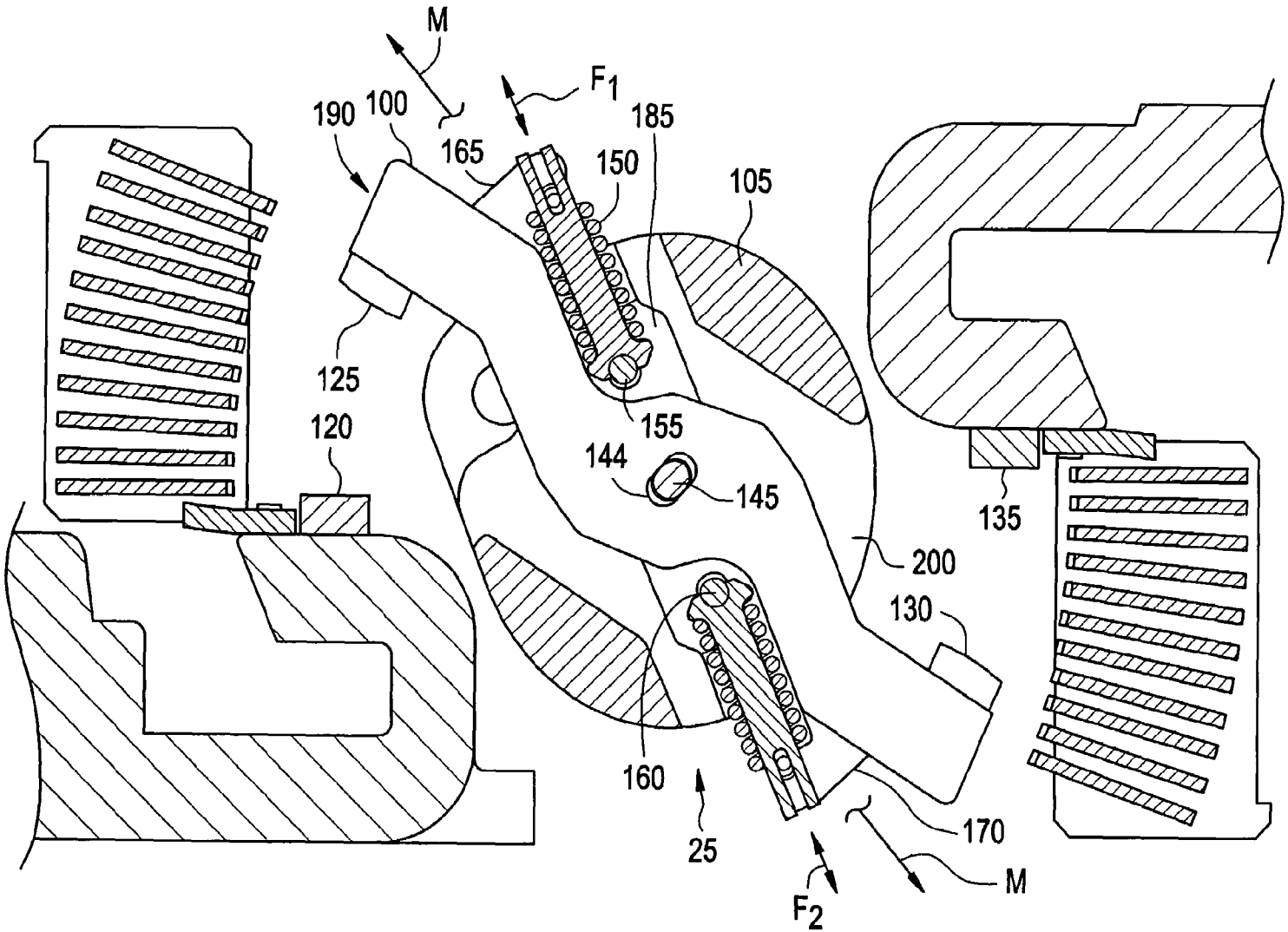
FIG. 3 depicts in cross section view the contact arm assembly of FIG. 1 with the contact arm in the BLOW OPEN position.

FIG. 3 illustrates an example of the contact arm assembly 25 immediately following the occurrence of an over current condition within the circuit breaker 50 that causes the contact arm 100 to blow open. The magnetic repulsion forces generated between the fixed contacts 120,135 and the movable contacts 125,130, between the line strap 115 and the contact arm 100, and between the load strap 140 and the contact arm 100, cause the contact arm 100 and associated movable contacts 125,130 to rotate about a pivot pin 145, which is disposed in pivot hole 144, in the clockwise direction to the BLOW OPEN position. Note that immediately following the over current event depicted in FIG. 3, the rotor 105 and side plate 185 have not changed position from the CLOSED position shown in FIG. 1.

In an embodiment, and with reference now to FIG. 1, contact arm 100 includes spring holders 165, 170 disposed equidistant from pivot hole 144. Side plates 185 and 186 (better seen by referring to FIG. 5) include notches 175, 180 for capturing pins 155, 160. The spring holders 165, 170 and pins 155, 160 are used for retaining contact springs 150 via spring retainers 210 disposed at the spring holders 165, 170, which will be discussed in more detail below. Direction vectors F1 and F2 are defined to pass through the center of the pins 155, 160 and the center of spring retainers 210, as depicted in FIG. 1, but best seen by referring to FIG. 8.

The geometry of the pins (also herein referred to as spring supports) 155, 160 and spring holders 165, 170 is arranged such that as the contact arm 100 rotates about pivot pin 145, relative to the rotor 105 and the side plates 185, 186, from the CLOSED position shown in FIG. 1 to the BLOW OPEN position shown in FIG. 3, the closing moment from springs 150 decreases, as can be seen by comparing the lines of force exerted by the springs 150, aligned with the direction vectors F1 and F2, relative to the pivot pin 145 in FIGS. 1 and 3. This decreasing moment will cause the blow open rotation of the contact arm 100 to be faster when responding to a short circuit condition. When the contact arm 100 is in the BLOW OPEN position, and the rotor 105 and side plates 185, 186 are in the CLOSED position, the lines of force exerted by the springs 150 along direction vectors F1 and F2 are driven toward the pivot pin 145 of the contact arm 100 to such a degree that the reaction moment exerted by the springs 150 is insufficient to cause the contact arm 100 to return to the CLOSED position. In an embodiment at the BLOW OPEN position, the direction vectors F1, F2 may rest within the friction circle of pivot 145, or may rest at an overcenter point relative to pivot 145.

Figure 4:
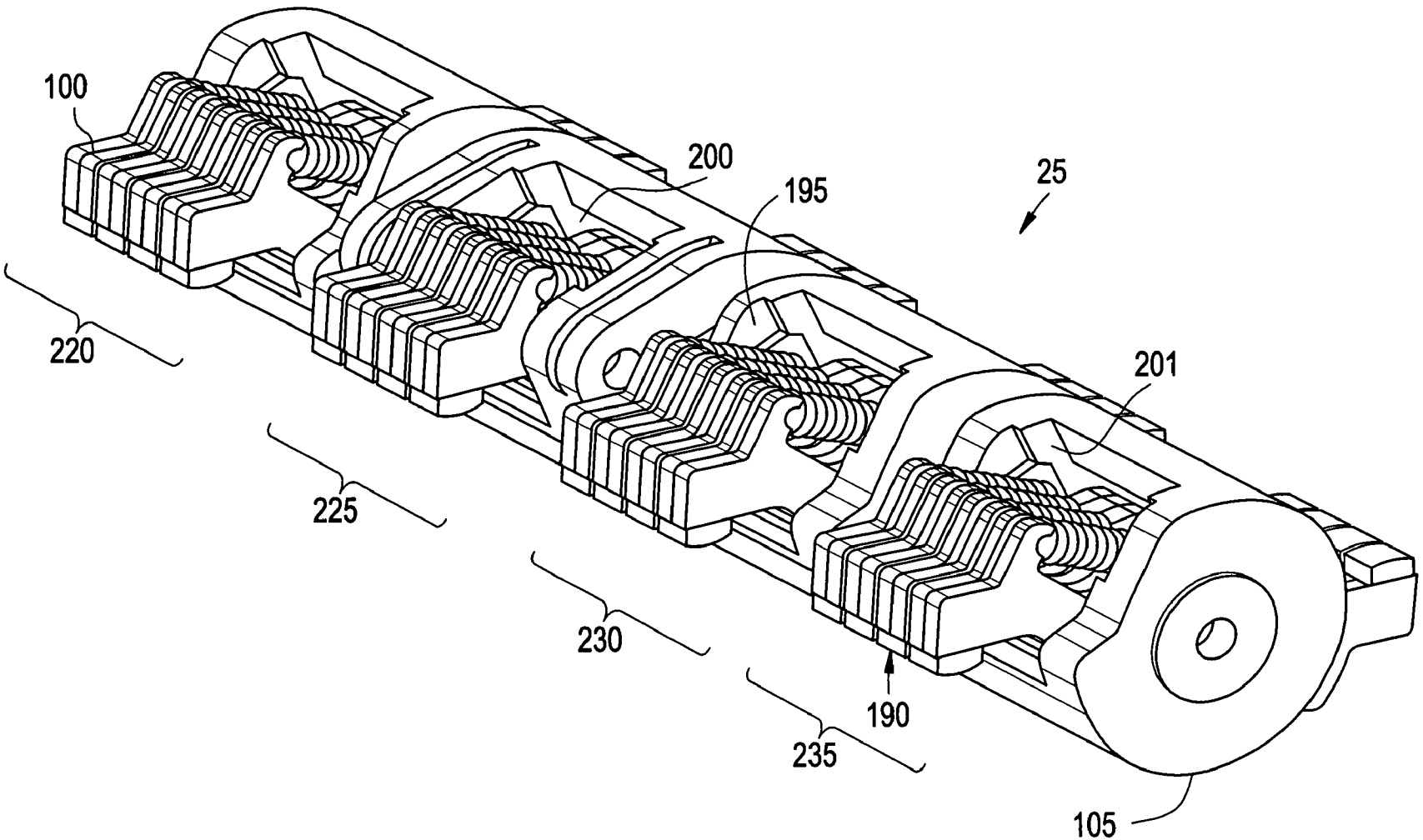
FIG. 4 depicts a top perspective view of an exemplary contact arm assembly in accordance with an embodiment of the invention.

Referring now to FIG. 4, a four-pole configuration of the contact arm assembly 25 is depicted in isometric view, which has one rotor 105 and four contact arm modules 190. While the embodiment described herein depicts four contact arm modules 220, 225, 230, and 235 (herein referred to generally as contact arm module 190), which may serve to protect phases A, B, C and neutral within a four-pole circuit breaker, it will be appreciated that the disclosed invention is also applicable to other circuit breakers such as a one, two, or three pole circuit breaker, for example.

Figure 5:
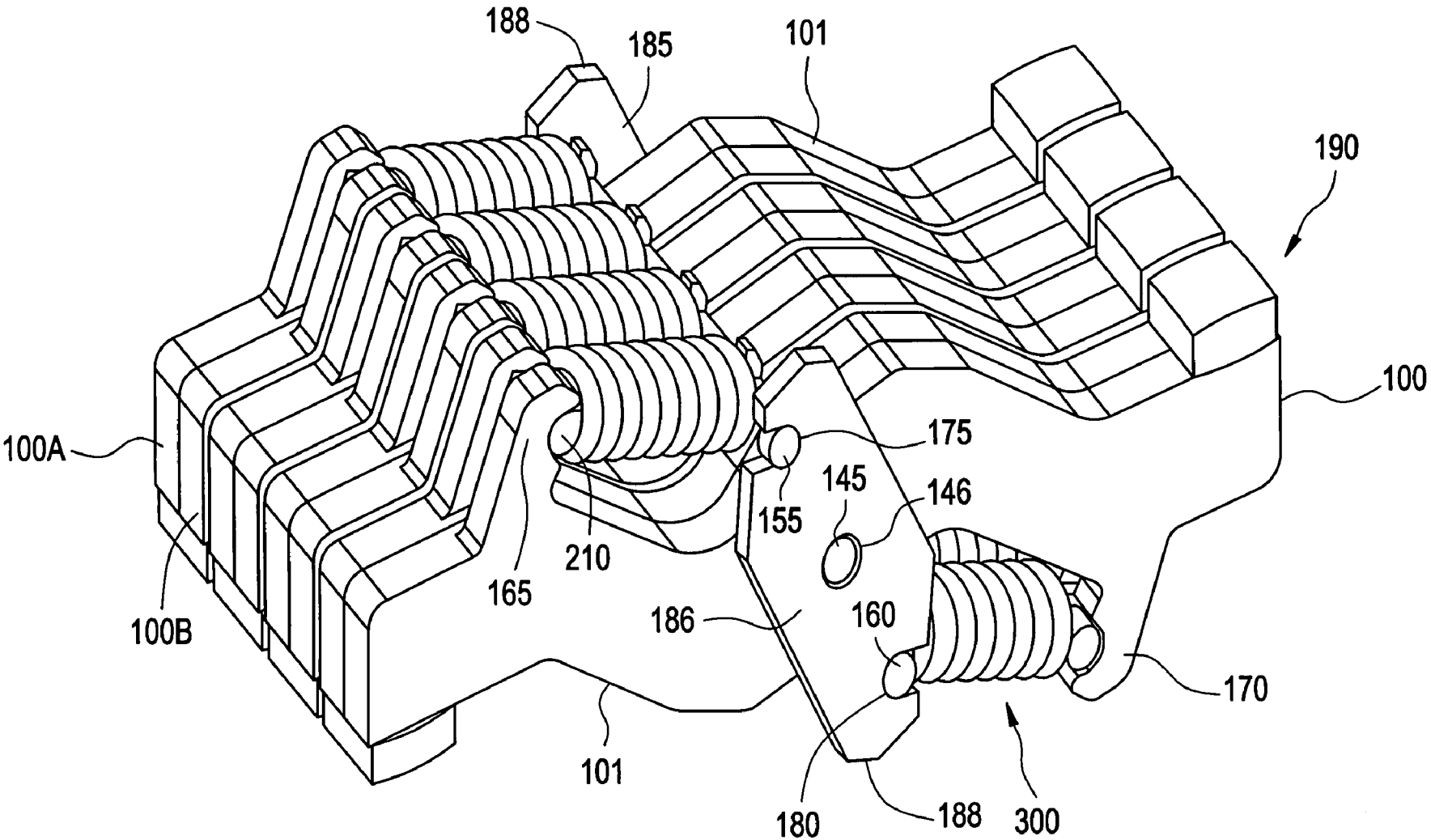
FIG. 5 depicts a top perspective view of an exemplary contact arm module in accordance with an embodiment of the invention.

An exemplary contact arm module 190 is shown in FIG. 5, which includes four contact arms 100, eight captivated spring subassemblies 300 (two per contact arm 100), two side plates 185,186 with notches 175, 180, two spring supports (pins) 155,160, and one pivot pin 145. Each side plate 185,186 is located on an opposing side of the set of contact arms 100. The pivot pin 145 extends through the entire width of the contact arm module 190 from pivot hole 146 in side plate 186 through the pivot hole 144 in each contact arm 100 to pivot hole 146 in side plate 185. While pivot holes 144 in contact arms 100 and pivot hole 146 in side plate 185 are not visible in FIG. 5, their presence will be readily understood by one skilled in the art with reference to other discussions and illustrations presented herein. Spring supports 155, 160 extend the width of the entire contact arm module 190 from one side plate 186 to the other side plate 185. The spring supports 155, 160 are engaged to side plates 185, 186 via notches (also herein referred to as support anchors) 175, 180. In an embodiment, each contact arm 100 is made by laminating two contact arms 100A and 100B together. While the embodiment described and illustrated herein depicts two contact arm laminations 100A, and 100B, four contact arms 100, and two side plates 185, 186, it will be appreciated that the disclosed invention is also applicable to an alternate number of contact arms, contact arm laminations, and side plates. For example, applications that may require different current ratings could utilize fewer or greater numbers of contact arms 100 or contact arm laminations 100A, 100B, as appropriate to carry different currents. For example, an embodiment may have only one contact arm 100 having a single lamination 100A, multiple contact arms 100 each having a single lamination 100A, a single contact arm 100 having a plurality of laminations 100A, 100B, or multiple contact arms 100 each having a plurality of laminations 100A, 100B. Further, it may be desirable in some applications to include additional side plates 185, 186.

Figure 6:
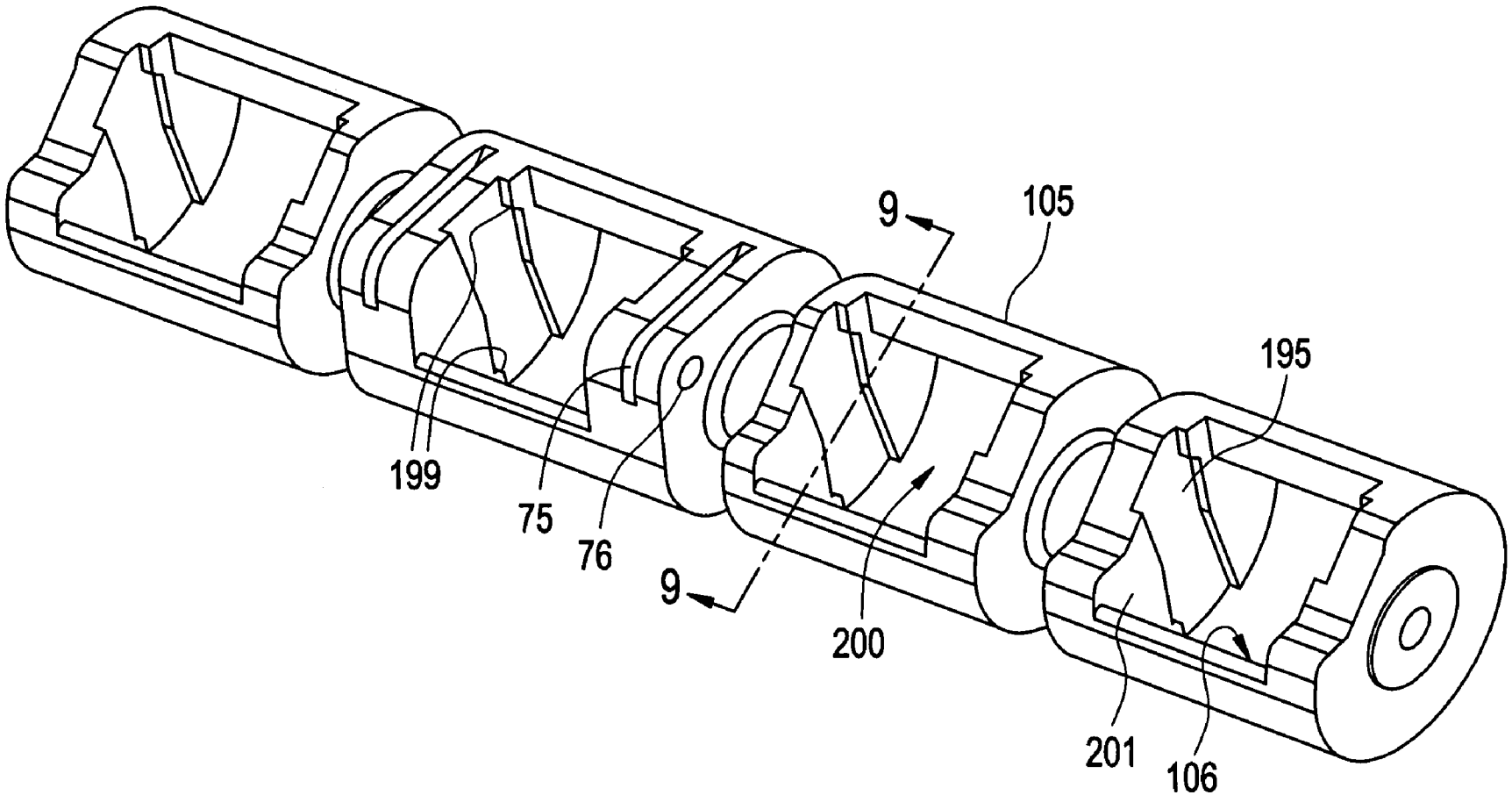
FIG. 6 depicts a top perspective view of an exemplary rotor in accordance with an embodiment of the invention.
Figure 7B:
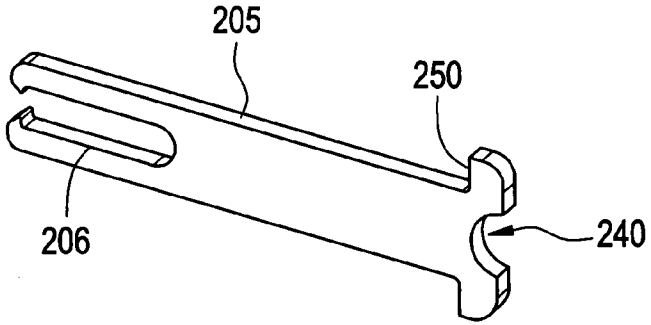
FIGS. 7B, 7C, and 7D depict a spring guide plate, a spring retainer, and an enlarged view of the spring guide plate, respectively, in accordance with an embodiment of the invention.
Figure 7D:
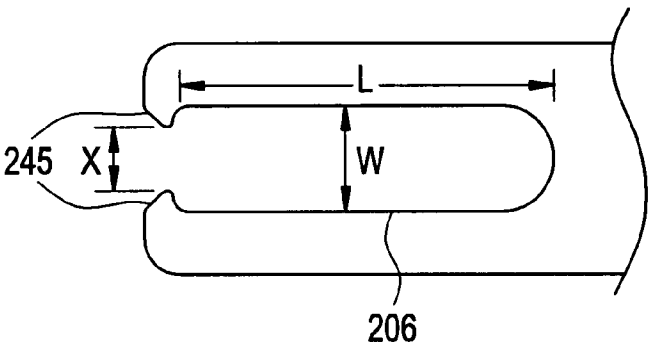
Figure 7A:
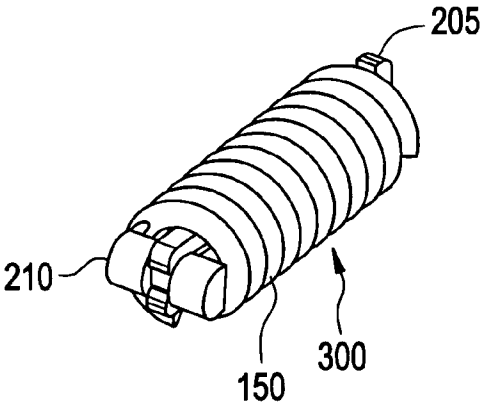
FIG. 7A depicts a captivated spring subassembly in accordance with an embodiment of the invention.
Figure 7C:
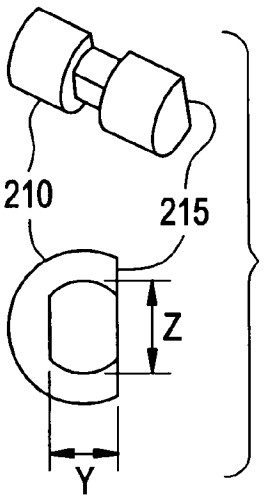

FIG. 6 illustrates an exemplary rotor 105. Within the rotor 105 there exist four cavities 200 for the insertion of contact arm modules 190. Slot 75 and pin hole 76 are provided to allow the rotor to be mechanically connected with the linkage 70 and operating mechanism 65. Further, each cavity 200 has sidewalls 201 in which there exists a recess 195. The geometry of the recesses 195 include rotor captivating edges 199. These edges interface with mating side plate captivating edges 188 (depicted in FIG. 5 on side plate 186) to help retain the side plates 185, 186 within the rotor 105. Each of the recesses 195 is designed to accept and contain the geometry of the side plates 185, 186 of the contact arm module 190 shown in FIG. 5. In response to the close fit between the recess 195 and the side plates 185, 186, the side plates 185, 186 will rotate with the rotor 105. As used here, the term "close fit" represents a minimum clearance condition with part tolerances considered. In another embodiment, a different fit may be selected, for example an interference fit. While the embodiment described herein depicts a single rotor 105 with four cavities 200, which in the illustrated embodiment contains four contact arm modules 190 to service phases A, B, C, and neutral within a four-pole circuit breaker, it will be appreciated that the disclosed invention is also applicable to other circuit breakers that may require the functionality of a double-break rotary contact arm, such as a one, two, or three pole circuit breaker for example.

Referring now to FIGS. 7A, 7B, 7C and 7D, an exemplary captivated spring subassembly 300 is depicted having springs 150, a spring guide plate 205, and a spring retainer 210. A captivated spring subassembly 300 allows for easier assembly of the springs 150 into the contact arm module 190. The captivated spring subassembly 300 also provides support via the spring guide plate 205 to ensure that each spring 150 does not buckle when it is compressed during blow open or otherwise. The width of the spring guide plate 205 is designed to be slightly smaller than the inside diameter of the spring 150. Retention tangs 245 are included at the end of the spring guide plate 205 in order to capture the spring retainer 210. In order to retain the spring 150 and spring retainer 210, the spring guide plate 205 is designed such that dimension X is smaller than dimension W (see FIG. 7D); the spring retainer 210 is designed such that dimension Z is slightly smaller than dimension W, but larger than dimension X (see FIGS. 7C and 7D); and dimension Y is only slightly smaller than dimension X (see FIGS. 7C and 7D). During assembly, the spring 150 is inserted onto the spring guide plate 205 until the spring 150 bottoms against the guide plate stop 250. The spring retainer 210 is then oriented such that dimension Y may slide within dimension X, and inserted into the slot 206 of the spring guide plate 205. Once the spring retainer 210 has been inserted, it is rotated ninety degrees to orient the flat surface 215 to face the spring 150 as shown in the assembly view of FIG. 7A. In response to orienting spring retainer 210, the large dimension Z of the spring retainer 210 will be captured by the retention tangs 245. The spring retainer 210 is now free to translate along length L of slot 206 within the spring guide plate 205 in the direction of compression of spring 150. In this way, the force created by spring compression is reacted between the spring retainer 210 and the spring guide plate 205 at guide plate stop 250. Spring guide plate 205 includes a support mating surface 240 that interfaces with the spring supports (pins) 155, 160, which is best seen by referring to FIG. 8 (discussed below). While the embodiment described herein depicts a compression spring 150 with flat spring guide plate 205, it will be appreciated that the disclosed invention may also utilize other forms of maintaining contact pressure. For example, an extension spring with an appropriate fastening means, or a spring guide plate of differing cross section may be employed to provide the necessary contact pressure.

Figure 8:
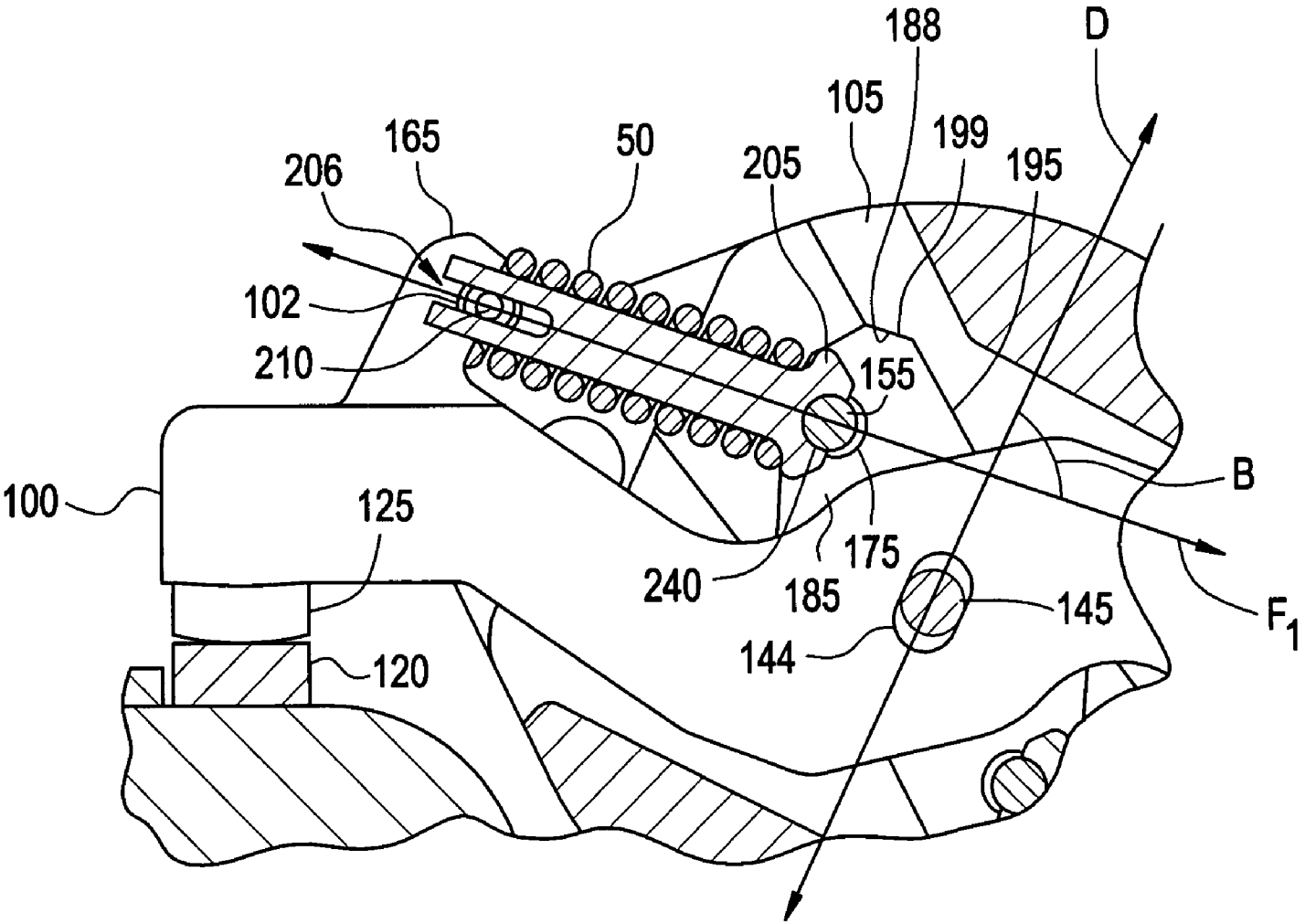
FIG. 8 depicts an enlarged partial cross section view of the contact arm assembly of FIG. 1 with the contact arm in the CLOSED position.
Figure 9:
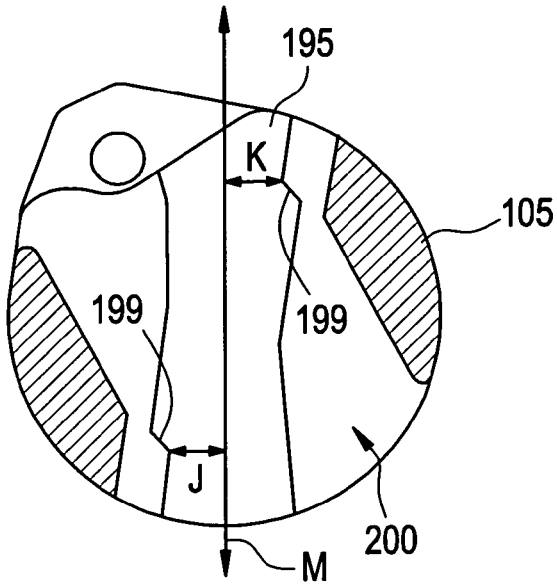
FIG. 9 depicts a cross section view of the rotor of FIG. 6.

Referring to FIG. 8, the interface between the spring guide plate 205 and first spring support 155 may be seen. This magnified view provides illustration of the components that provide contact pressure between the fixed contact 120 and the movable contact 125. The spring 150 exerts pressure upon the spring guide plate 205 and spring retainer 210. The spring retainer 210 is free to translate within the slot 206 of the spring guide plate 205. The position of the rotor 105 is determined by the operating mechanism 65 and linkage 75, and is therefore not free to move. Because the spring support 155 is retained at the side plate 185 via notch 175, which is in turn contained within the rotor recess 195, the spring support 155 is also fixed in position, and therefore the end of the spring guide plate 205 at support mating surface 240 is fixed. The compressive force generated by the spring 150, which is grounded at the rotor 105, is transferred to the spring holder 165 of the contact arm 100 via a pocket 102 formed in the spring holder 165 that the spring retainer 210 fits within. In an embodiment, cylindrical surfaces between the support mating surface 240 and pin 155, and between the spring retainer 210 and pocket 102 of contact arm 100, allow the support mating surface 240 to pivot about pin 155, and the spring retainer 210 to pivot around the pocket 102. The ability to pivot at one or both of these interfaces provides for smooth contact arm rotation. Because the contact arm 100 is free to rotate via pivot hole 144 about pivot pin 145, a rotational counterclockwise moment relative to the rotor 105 is provided by the spring force exerted on the contact arm 100 via springs 150. This rotational moment thereby causes the contact force between the movable contact 125 and the fixed contact 120. A reaction to this counterclockwise moment exerted by the springs 150 on contact arm 100 is a clockwise moment exerted between the side plate 185 and the rotor 105. This clockwise moment, along with side plate captivating edge 188 and rotor captivating edge 199, works to prevent translation of the side plate 185 within the recess 195 of the rotor 105. FIGS. 5, 6 and 9 provide alternate perspectives of the side plate captivating edge 188 and rotor captivating edge 199.

The line of spring force exerted by springs 150 is aligned with direction vectors F1, F2 and is located in a plane that is orthogonal to the center axis of the pivot pin 145. The pivot hole 144 of contact arm 100 may be elongated as illustrated in the various figures. Referring to FIG. 8, a direction vector D is defined as passing through the center of pivot hole 144 and being aligned with the orientation of elongation, as illustrated. The orientation of elongation is selected to provide an included angle C of about ninety degrees between direction vector D and direction vector F1 (and F2, not shown in FIG. 8, but shown in other Figures) in response to the contact arm being in the CLOSED position, as illustrated in FIG. 8. It will be appreciated that the included angle C may vary somewhat as a result of tolerances and desired performance characteristics of circuit breaker 50. Elongation of the pivot hole 144 allows the contact arm 100 to compensate for tolerances between each of the contact arms 100 and the fixed contacts 120,135 within a contact arm assembly 25. This tolerance compensation may relate to differences in the manufacturing processes as well as wear of the contacts 120, 125, 130, 135. It will be appreciated that the foregoing explanation, with reference to FIG. 8, pertains to one half of the geometry of contact arm 100, and that a complementary set of symmetrical reactions are duplicated on the other half of the contact arm 100.

The contact arm module 190 depicted in FIG. 5 provides an alternative perspective of the aforementioned interface between spring retainer 210 and spring holder 165, and the relative rotational relationship between each contact arm 100 and the side plates 185,186 via the common pivot pin 145. As can be seen in FIG. 5, the embodiment described herein depicts a captivated spring subassembly 300 and contact arm 100 that have axial centerlines on the same plane orthogonal to the pivot pin 145, that is, each spring subassembly 300 is oriented in line with its associated contact arm 100.

As described above and shown in FIG. 4, the contact arm assembly 25 has a rotor 105 and contact arm module 190. The rotor 105 has cavities 200 into which the contact arm modules 190 are positioned. On the cavity sidewalls 201, there are recesses 195, which are oriented generally in the direction of molding of the cavity 200 openings. Referring to FIG. 9, the orientation of the recess 195 is shown by the direction vector M (also herein referred to as the insertion line M). Insertion line M extends through the center of rotation of the rotor, and is located such that dimension J is equal to dimension K.

Referring to FIG. 2, it is shown that the side plate 185 is captured within recess 195, and that any attempt to translate side plate 185 relative to recesses 195 is confined in the general direction M. It also shown in FIG. 2 that any attempt to translate contact arm module 190 in the direction indicated by M would be confined by an interference between the contact arm 100 and the frame of the rotor 105 which is depicted by the interface surfaces 101 and 106 on the contact arm 100 and the rotor 105, respectively. Further, the compressive force of the springs 150 creates a reaction that applies a counterclockwise moment to the contact arm 100 and a clockwise moment to the side plate 185. This clockwise moment drives the side plate 185 into the recess 195 of the rotor 105 such that the sideplate captivating edge 188 and rotor captivating edge 199 also prevent any translation of the contact arm module 190. However, when the contact arm 100 is in the BLOW OPEN position as shown in FIG. 3, the contact arm module 190 may be rotated counterclockwise to disengage the side plate captivating edges 188 from the rotor captivating edges 199, thereby allowing the contact arm module 190 to be translated into and out of the rotor cavity 200 along direction M without interference with the rotor 105 frame.

Accordingly, assembly of the contact arm module 190 into rotor 105 will now be discussed with reference to FIGS. 2, 3, 9, 10 and 11.

Figure 10:
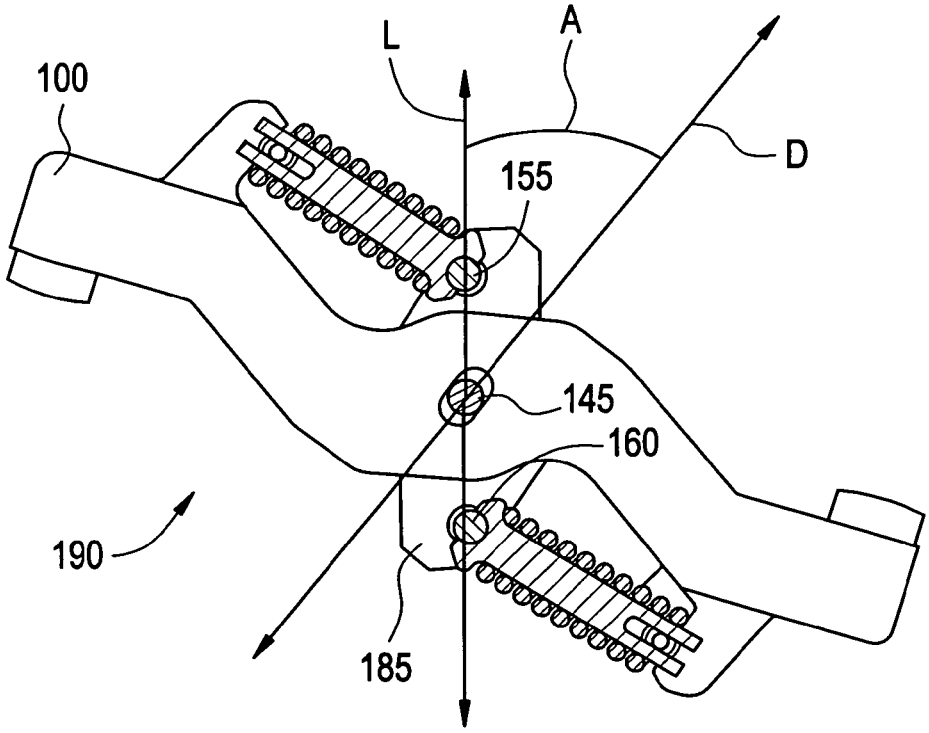
FIG. 10 depicts a side view of the contact arm module of FIG. 5 in a first angular orientation and with some parts removed for clarity.

An initial orientation of a contact arm module 190 is depicted in FIG. 10. The direction vector L extends through the center of the pivot pin 145 and the spring holders 155, 160 as shown. This direction vector L (also herein referred to as the axial centerline of the side plate 185), represents the general direction that the side plate 185 will translate as it is inserted into the recesses 195 of the cavities 200 within the rotor 105. As described above, direction vector D defines the orientation of contact arm pivot 144 elongation. In this initial orientation, an interior angle A is defined by the angle formed between direction vector D and direction vector L.

Figure 11:
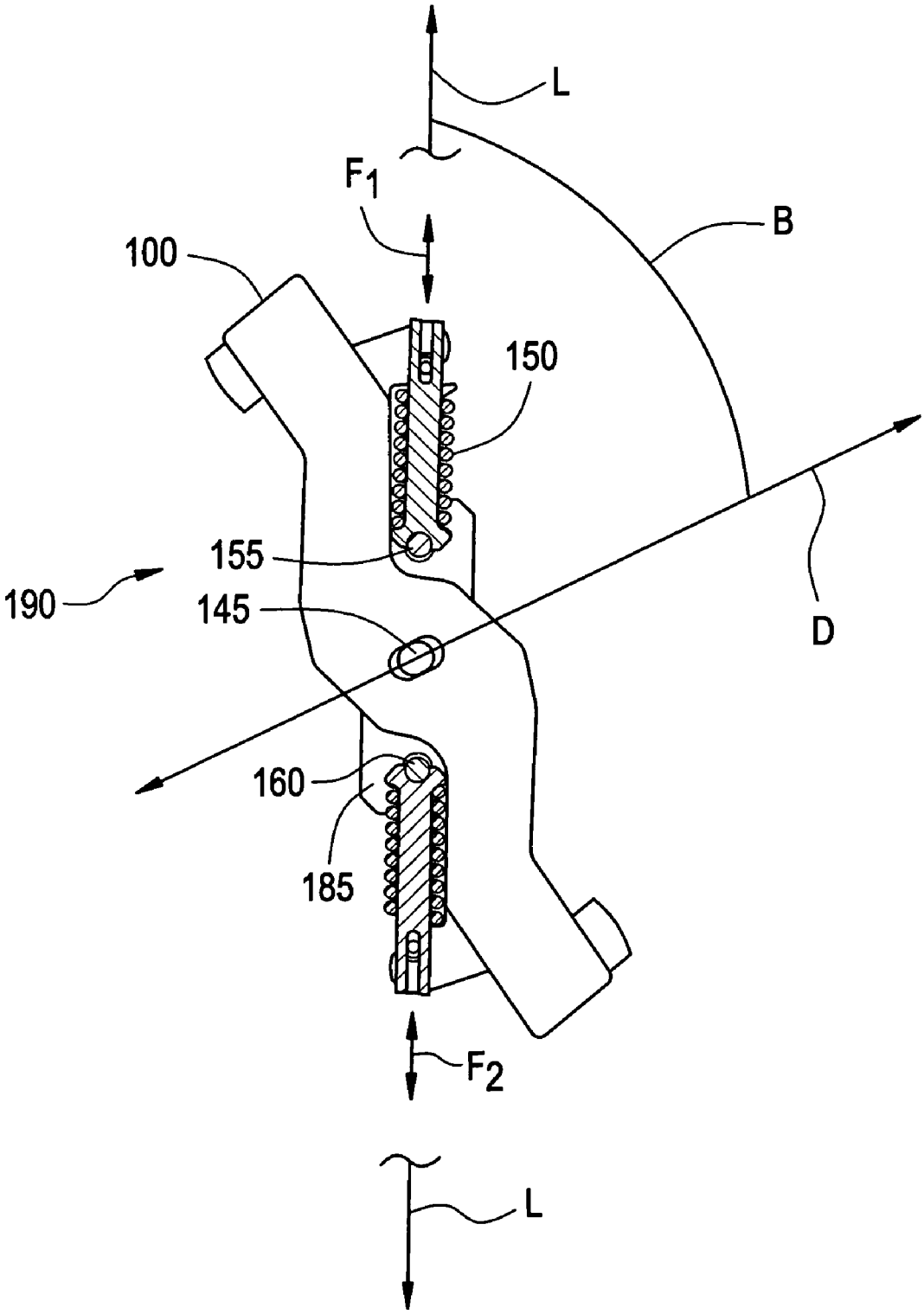
FIG. 11 depicts a side view of the contact arm module of FIG. 5 in a second angular orientation and with some parts removed for clarity.

With reference still to FIG. 10, clockwise rotation of the contact arm 100 relative to the side plate 185 and spring supports 155, 160, increases the interior angle between direction vector D and direction vector L, until the contact arm module 190 is in a second orientation with interior angle B, as depicted in FIG. 11. In this second orientation of FIG. 11, the line of force of spring 150 directed along F1, F2 is sufficiently driven toward the common pivot pin 145 of the contact arm 100 and the side plate 185 thereby resulting in a reaction moment exerted by the springs 150 that is insufficient to cause relative rotation between the contact arm 100 and side plate 185 back to the initial orientation depicted in FIG. 10. Therefore, the contact arm module 190 will remain in the second orientation depicted in FIG. 11 until the contact arm 100 is acted upon by an external counterclockwise moment relative to the side plate 185. While the embodiment described herein depicts a contact arm module 190 which, when oriented as in FIG. 11, will not have a sufficient moment to cause relative rotation between the contact arm 100 and side plate 185, it will be appreciated that the disclosed invention may utilize an arrangement of spring supports 155, 160 and spring holders 165, 170 to provide an overcentering moment when the contact arm module 190 is oriented similar to that shown in FIG. 11 to maintain the open position of the contact arm 100.

While the contact arm module 190 is in the orientation shown in FIG. 11, it may be inserted into cavity 200 of the rotor 105. By generally aligning the axial centerline L of the side plate 185 with the insertion line M of the recess 195 in the sidewall of the cavity 200 of the rotor 105, as shown in FIG. 9, the side plate 185 will readily fit within the recess 195.

Referring back to FIG. 3, a representation of the assembly following insertion of the contact arm module 190 into the rotor 105 is seen. Following the insertion of the contact arm module 190 into the cavity 200 of the rotor 105, application of a counterclockwise moment to the set of contact arms 100 relative to the side plate 185 will cause the contact arms 100 to rotate relative to the rotor 105. The resulting reactionary clockwise moment of the side plate 185 relative to the rotor 105, combined with the side plate captivating edges 188 and rotor captivating edges 199, will prevent translation of the side plate 185 and contact arm module 190 relative to the rotor 105, thereby captivating contact arm module 190 in rotor 105, resulting in a captivated contact arm assembly 25 as illustrated in FIG. 2.

While the embodiment described herein depicts an assembly method including spring subassemblies 300 within the contact arm module 190, it will be appreciated that the disclosed invention may also utilize other methods of assembly. For example, installation of the spring subassemblies 300 into the contact arm module 190 may follow insertion of the contact arm module 190 into the rotor 105.

As disclosed, some embodiments of the invention may include some of the following advantages: approximately constant force during rotation of the contact arm for developing contact pressure; faster opening speed of the contact arms during a short circuit, which results from a decreasing spring-force moment as the movable contacts are blown away from the fixed contacts; increased ease of assembly provided by captivated spring subassemblies; unitized design of the contact arm module; increased ease of assembly via arrangement of the spring supports and the spring holders to hold the contact arms in a second angular orientation relative to the side plates; and, increased ease of assembly via mating side plate and rotor captivating edges.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A contact arm assembly comprising a contact arm module, the contact arm module, the contact arm module comprising:

a set of contact arms, each of the contact arms comprising a pivot hole, two contacts, and two spring holders;

two side plates, each one disposed on an opposing side of the set of contact arms, each of the side plates comprising a pivot hole, and first and second support anchors;

a first spring support disposed at the first support anchors of each of the side plates;

a second spring support disposed at the second support anchors of each of the side plates;

a pivot pin disposed through the pivot holes of the set of contact arms and the pivot holes of the two side plates; and a set of springs, each of the springs disposed between one of the first and second spring supports and one of the spring holders of the set of contact arms.

2. The contact arm assembly of claim 1, further comprising:

a rotor having a set of cavities;

wherein the contact arm module is disposed within one of the cavities of the rotor.

3. The contact arm assembly of claim 2, wherein:

each of the cavities of the set of cavities comprises recesses configured to receive the two side plates of one of the contact arm modules; and the recesses are configured to cause the side plates to rotate together with the rotor.

4. The contact arm assembly of claim 1, wherein:

the spring holders and the spring supports are arranged to provide for a declining spring force moment in response to the set of contact arms being blown open relative to stationary side plates.

5. The contact arm assembly of claim 4, wherein:

in response to the set of contact arms being in a blown open position, the spring holders and the spring supports are arranged to orient the set of springs such that a line of force developed by the set of springs will be insufficient to cause rotation of the set of contact arms relative to the side plates.

6. The contact arm assembly of claim 1, wherein:

each of the contact arms of the set of contact arms comprises laminations.

7. The contact arm assembly of claim 1, further comprising:

a guide plate disposed within each of the springs of the set of springs to prevent the springs from buckling; and a spring retainer disposed within a slot of the guide plate, the spring retainer and guide plate being configured to capture the spring in a subassembly.

8. The contact arm assembly of claim 7, wherein:

an interface exists between the spring retainer and the spring holder and;

an interface exists between the guide plate and one of the spring supports and;

the interface between the spring retainer and the spring holder is cylindrical to provide a pivotal surface for smooth contact arm rotation and;

the interface between the guide plate and the spring support is cylindrical to provide a pivotal surface for smooth contact arm rotation.

9. The contact arm assembly of claim 1, wherein:

each of the springs of the set of springs has a central axis disposed in a plane orthogonal to the center of each of the contact arm pivot holes; and the central axis of each of the springs is disposed in the same plane as the centerline of an associated one of the contact arms.

10. The contact arm assembly of claim 1, wherein:

each of the of the contact arms pivot holes is elongated;

the set of springs exert a force on the set of contact arms; and the orientation of elongation is about ninety degrees relative to the direction of spring force in response to the contact arms being in a CLOSED position.

11. A contact arm assembly, comprising:

a set of contact arms, each of the contact arms having a pivot hole;

two side plates, each one disposed on an opposing side of the set of contact arms;

two spring supports disposed between the two side plates and parallel to each other; and a set of springs captivated between the set of contact arms and at least one of the two spring supports.

12. The contact arm assembly of claim 11, further comprising:

a rotor having a set of cavities;

wherein one of the set of contact arms is disposed within one of the set of cavities of the rotor; and wherein each of the cavities of the set of cavities comprises recesses configured to receive the two side plates.

13. The contact arm assembly of claim 12, wherein:

each of the springs of the set of springs has a central axis disposed in a plane orthogonal to the contact arm pivot holes.

14. A method of assembling a contact arm assembly, the contact arm assembly comprising a contact arm module and a rotor, the rotor having a cavity with interior side walls, the contact arm module comprising a set of contact arms captivated between and pivotally arranged with two side plates, the method comprising:

receiving the contact arm module with the set of contact arms and side plates in a first angular orientation defined by an interior angle A, rotating the set of contact arms relative to the side plates in a direction that increases the interior angle A, thereby defining a second angular orientation; and with the contact arm module in the second angular orientation, inserting the contact arm module into the cavity of the rotor such that the side plates engage with the interior side walls of the cavity, and rotating the set of contact arms relative to the side plates to cause the contact arm module to return toward the first angular orientation, thereby captivating the contact arm module within the rotor.

15. The method of assembly of claim 14, wherein the inserting the contact arm module into the cavity of the rotor comprises:

inserting the contact arm module into the cavity of the rotor until captivating edges of the two side plates engage with captivating edges at the interior side walls of the cavity.

16. The method of assembly of claim 14, further comprising:

installing captivated spring subassemblies so as to exert a spring load between the set of contact arms and the two side plates.

17. The method of assembly of claim 16, wherein the installing comprises:

installing the captivated spring subassemblies subsequent to inserting the contact arm module into the rotor.

18. The method of assembly of claim 16, wherein the installing comprises:

installing the captivated spring subassemblies prior to inserting the contact arm module into the rotor.

19. The method of assembly of claim 18, wherein the rotating the set of contact arms relative to the side plates to the second angular orientation comprises:

rotating the set of contact arms relative to the side plates until a line of force exerted by the captivated spring assemblies is sufficiently driven toward a friction circle of the common pivot of the contact arms and the side plates such that a reaction moment caused by the springs is insufficient to cause the contact arms to return to the first angular orientation, thereby causing the set of contact arms to remain stationary relative to the side plates.

20. The method of assembly of claim 18, wherein the rotating the set of contact arms relative to the side plates to the second angular orientation comprises:

rotating the set of contact arms relative to the side plates until a line of force exerted by the captivated spring assemblies is driven toward an overcenter point relative to the common pivot of the contact arms and the side plates, thereby causing the set of contact arms to remain stationary relative to the side plates.

* * * * *

UNITED STATES PATENT AND TRADEMARK OFFICE

CERTIFICATE OF CORRECTION

PATENT NO. : 7,189,935 B1
APPLICATION NO. : 11/298078
DATED : March 13, 2007
INVENTOR(S) : Girish Hassan et al.

It is certified that error appears in the above-identified patent and that said Letters Patent is hereby corrected as shown below:

Column 3,
Line 21, after "breaker", delete "500N" and insert therefor --50 ON--.

Column 9,
Line 34, after "module," delete "the contact arm module,".

Column 10,
Line 39, after "each", delete "of the".

Signed and Sealed this

Twelfth Day of June, 2007

JON W. DUDAS
*Director of the United States Patent and Trademark Office*